US008545059B2

(12) United States Patent
Chen et al.

(10) Patent No.: US 8,545,059 B2
(45) Date of Patent: Oct. 1, 2013

(54) ELECTRODELESS LAMP STREET LIGHTING FIXTURE

(75) Inventors: Wenjun Chen, West Covina, CA (US); Wenxin Kang, Fujian (CN); Hequan Zhang, Fujian (CN)

(73) Assignee: Fujian Juan Kuang Yaming Electric Limited, Nanping, Fujian (CN)

( * ) Notice: Subject to any disclaimer, the term of this patent is extended or adjusted under 35 U.S.C. 154(b) by 0 days.

(21) Appl. No.: 12/994,110

(22) PCT Filed: Sep. 9, 2010

(86) PCT No.: PCT/CN2010/076749

§ 371 (c)(1), (2), (4) Date: Nov. 22, 2010

(87) PCT Pub. No.: WO2012/031397

PCT Pub. Date: Mar. 15, 2012

(65) Prior Publication Data

US 2013/0155684 A1 Jun. 20, 2013

(51) Int. Cl.
*F21V 19/02* (2006.01)

(52) U.S. Cl.
USPC ..... 362/285; 362/373; 362/458

(58) Field of Classification Search
USPC ..... 362/285, 373, 431, 263, 311.14, 362/458, 310, 296, 287, 269; 40/557
See application file for complete search history.

(56) References Cited

U.S. PATENT DOCUMENTS 5,892,621 A * 4/1999 McGregor et al. ..... 359/599
2011/0205746 A1* 8/2011 Lundin et al. ..... 362/373

FOREIGN PATENT DOCUMENTS

CN 201487616 U * 5/2010

OTHER PUBLICATIONS

English Translation of CN201487616U May 2010.*

* cited by examiner

*Primary Examiner* — Mariceli Santiago
*Assistant Examiner* — Glenn Zimmerman

(57) ABSTRACT

An electrodeless lamp street lighting fixture comprises a housing, an electronic ballast, and a light emitter that comprises a light bulb, a light reflecting cover, and a transparent cover fixed together. The light emitter and the electronic ballast could be pivotally connected to the housing. An external surface of the housing is served as a radiating plane of the electronic ballast. Therefore, the present invention needs no tool for dismantlement, the radiating effect of the electronic ballast is satisfactory, and the installment is convenient.

5 Claims, 2 Drawing Sheets

ELECTRODELESS LAMP STREET LIGHTING FIXTURE

BACKGROUND OF THE INVENTION

1. Field of the Invention

The present invention relates to the lighting equipment, in particular to an electrodless lamp street lighting fixture that radiates well and could be readily disassembled without tools.

2. Description of the Related Art

The electrodeless lamp in the market usually utilizes the electromagnetic induction to function. Namely, a high frequency inducts a magnetic field for coupling the energy into the lamp. Thereby, the energy allows the gas within the lamp to proceed to the avalanche ionization and form the plasma. Wherein, when the plasma atom that is excited returns to the original state, the acquired energy would be radiated by 253.7 nm ultraviolet, so that an energy transformation is completed. Moreover, the fluorescent powder on the inner wall of the lamp is excited to emit the visible light. In addition, without the electrode, the electrodeless lamp contains no vulnerable element. Further, the operating life of the entire mechanism depends on the electronic ballast, which means this kind of fluorescent lamp has a long using life, more than 60 thousand hours. Therefore, the electrodeless lamp is especially suited to occasions as follows: when the replacement of the lamp is rather difficult, or when the cost of the lamp is expensive. Other central places that require an ensured safety also need the same lamp. For example, the main roads, tunnels, traffic busy zones, stations of the Metropolitan Rapid Transportation, factories whose ceiling is placed high, danger zones, lobbies, or sports grounds.

Existing lamp for the electrodeless illuminant usually comprises a housing, an electrodeless lamp, a light reflecting cover, a transparent cover, and an electrical unit. The housing further includes an upper housing and a lower housing. The electrodeless lamp is placed in the light reflecting cover. The electrodeless lamp along with the light reflecting cover is disposed in the housing. Thereby, afore construction is wrapped in the transparent cover. Herein, a rim of the transparent cover is actually disposed within the housing. The electrical unit is installed in the housing and connected to the electrodeless lamp. Wherein, the fixtures of the upper housing, the lower housing, the electrodeless lamp, and the electrical unit are all achieved by screws. While replacing the damaged electrodeless lamp or the broken electrical unit, a screw driver is needed for unscrewing the screws between the upper housing and the lower housing. Thereby, the lower housing is removed from the upper housing. Then, the electrodeless lamp or any electrical element in the electrical unit could be removed, and vice versa. The removing procedure or the assembling procedure seems simple, but it becomes difficult while the removing procedure or the assembling procedure is operated at a high place. Moreover, if the screw driver or the screw is accidentally dropped, people on the ground would easily get hurt, which is very dangerous.

A Chinese Publication No. CN201487616U publicized on May 26, 2010 discloses a lamp for the electrodeless fluorescent illuminant to solve aforementioned problems. The lamp forms a light emitter that is composed of an electrodeless lamp, a light reflecting cover, and a transparent cover fixed together. Thereby, the light emitter is pivoted to a housing of the lamp. Herein, the electrical elements are concentrically arranged on a movable tray that is also pivoted to the housing. Accordingly, even the replacement of the electrodeless light and the electrical elements removes no screws, and any tools are also needless, the light emitter and the moveable tray can be still simply disassembled. Thus, the replacing procedure operated on the high place becomes effortless, and the safety of the people on the ground is assured. Moreover, the disassembled parts could be replaced or repaired on the ground and thence installed back again. However, although such disclosure does not need tools to do the disassembling, and the operating procedure is rather safe and convenient, there are still disadvantages existing in such disclosure as follows:

1. The electrical elements including the electronic ballast are disposed on the movable tray that is connected to the housing for forming an accommodating room in the housing. Although there are through holes defined on the accommodating room for radiating, the radiating effect is actually unsatisfactory since the heat of the electronic ballast firstly flows within the narrow and small accommodating room and thence the heat is further dispersed out of the accommodating room via the through holes.

2. The level status of the assembled lamp for the electrodeless fluorescent illuminant should follow a high standard. At present, the lamp is firstly preset and thence adjusted in accordance with a level. Obviously, such assembling means not only takes time but also labors.

SUMMARY OF THE INVENTION

The object of the present invention is to provide an electrodeless lamp street lighting fixture that requires no tools while disassembling. Moreover, the radiating effect of the electrical ballast is satisfactory, and the operating procedure is convenient.

The present invention is achieved by the following techniques: An electrodeless lamp street lighting fixture comprises a housing, an electronic ballast, and a light emitter that is composed of a light bulb, a light reflecting cover, and a transparent cover fixed together. The light emitter and the electronic ballast are able to pivotally connect to the housing. Characterized in that, an external surface of the housing is served as a radiating plane of the electronic ballast.

The housing includes a rear lid to be served as the radiating plane of the electronic ballast.

A level is disposed on the lamp.

An accommodating room for receiving an electrical switch is defined on the housing above the electronic ballast; a top lid is further disposed above the accommodating room; the level is disposed within the accommodating room.

The light emitter is connected to the housing via a flexible pivot and fixed to the housing via a flexible buckle; the electronic ballast is fixed to the housing via wing screws.

Advantages of the present invention are as follows: no tools are needed for the disassembling since the dispositions of the light emitter and the electronic ballast are special, and the operating procedure at the high place is rather safe and convenient. Moreover, the safety of the people on the ground is assured, and the disassembled parts could be replaced or repaired on the ground and thence installed back again. Additionally, the external surface of the housing is served as the radiating plane of the electronic ballast, so the heat dispersing is direct and satisfactory. Moreover, the level disposed on the present invention is further beneficial for the assemblage of the lamp.

DETAILED DESCRIPTION OF THE PREFERRED EMBODIMENTS

Figure 1:
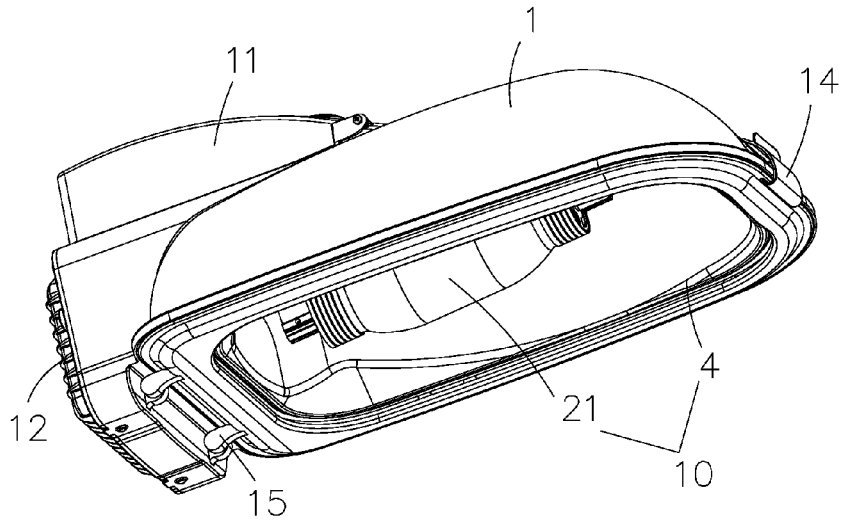
FIG. 1 is a schematic view showing the present invention.
Figure 2:
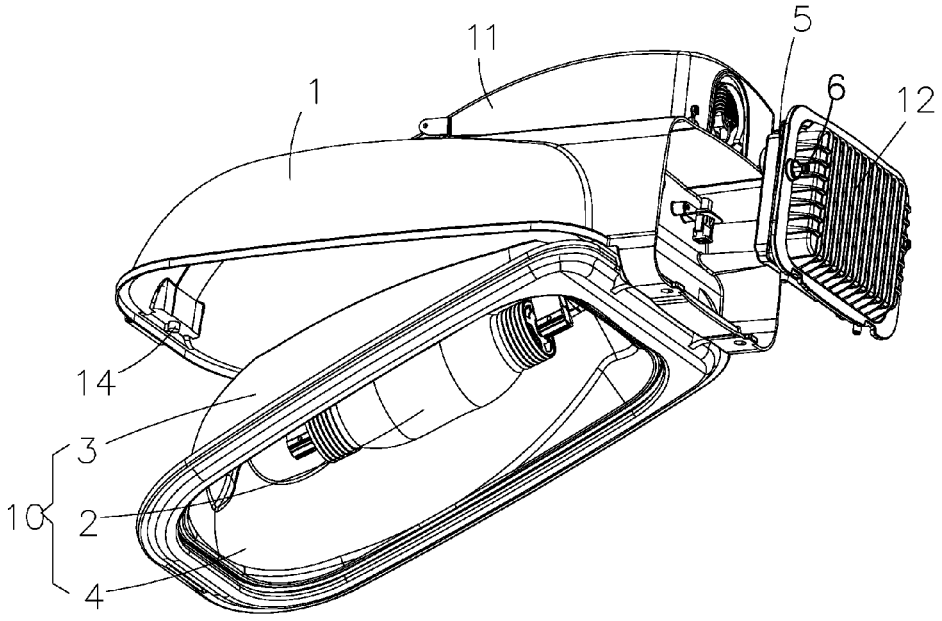
FIG. 2 is a schematic view showing the opened present invention.
Figure 3:
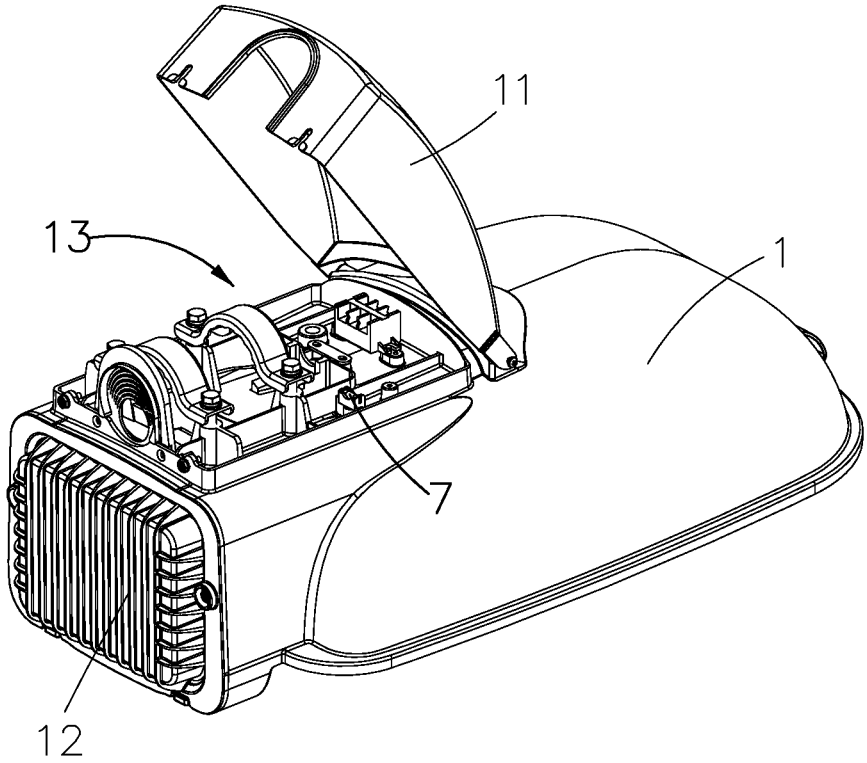
FIG. 3 is a schematic view showing the rear portion of the present invention.

Referring to FIGS. 1 to 3, an electrodeless lamp street lighting fixture comprises a housing 1, a light bulb 2, a light reflecting cover 3, a transparent cover 4, and an electronic ballast 5.

The housing 1 has a top lid 11 and a rear lid 12. Under the top lid 11, an accommodating room 8 is defined for receiving an electrical switch or other similar parts. The electronic ballast 5 is disposed in back of the light bulb 2, under the electrical switch. The rear lid is served as a radiating plane of the electronic ballast 5. That is to say, the radiating plane of the electronic ballast directly contacts the air so as to radiate, which results in a brilliant radiating effect.

A light emitter 10 is composed of the light bulb 2, the light reflecting cover 3, and the transparent cover 4 fixed together. The light emitter 10 is pivotally connected to the housing 1. In operation, the light emitter 10 is connected to the housing 1 via a flexible pivot 13 and fixed to the housing 1 via at least one flexible buckle 14. The electronic ballast 5 is fixed to the housing 1 via wing screws 6. Alternatively, the fixture of the electronic ballast 5 could be also achieved by the flexible buckling.

A level 7 is further disposed at a suitable position of the lamp, so that the lamp could be installed in accordance with a certain standard reference. In operation, the level 7 is disposed in the accommodating room 8 under the top lid 11.

Moreover, the light bulb 2 and the electronic ballast 5 are electrically connected via an insertion (not shown). The insertion is installed out of the light emitter 10, in the housing 1.

The light emitter 10 could be taken apart by respectively unbuckling the flexible buckle 14, so that the mechanism is shown as FIG. 2. Thence, the insertion is broken for users to further press the elastic sheet 9 of the flexible pivot 13. Thereby, the light emitter 10 could be dismantled. Succeedingly, the dismantled light emitter 10 could be replaced or repaired on the ground, and vice versa. By means of the level 7, the assemblage of the lamp could be adjusted in accordance with a certain standard.

Similarly, in disassembling the electronic ballast 5, the wing screws 6 are unscrewed as shown in FIG. 2. Thereby, the insertion is broken for users to take the electronic ballast 5 apart. Thereby, the disassembled electronic ballast 5 could be replaced or repaired on the ground, and vice versa.

Accordingly, the present invention contributes to a simple structure, the easy dismantlement, and a convenient operating procedure at the high place.

We claim:

1. An electrodeless lamp street lighting fixture comprising a housing, an electronic ballast, and a light emitter that comprises a light bulb, a light reflecting cover, and a transparent cover fixed together; said light emitter and said electronic ballast being able to pivotally connect to said housing; characterized in that, an external surface of said housing is served as a radiating plane of said electronic ballast.

2. The lamp as claimed in claim 1, wherein, said housing includes a rear lid to be served as said radiating plane of said electronic ballast.

3. The lamp as claimed in claim 1, wherein, a level is disposed on said lamp.

4. The lamp as claimed in claim 3, wherein, an accommodating room for receiving an electrical switch is defined on said housing above said electronic ballast; a top lid is further disposed above said accommodating room; said level is disposed within said accommodating room.

5. The lamp as claimed in claim 1, wherein, said light emitter is connected to said housing via a flexible pivot and fixed to said housing via a flexible buckle; said electronic ballast is fixed to said housing via wing screws.

* * * * *